US009561596B2

(12) United States Patent
Buck, Jr.

(10) Patent No.: US 9,561,596 B2
(45) Date of Patent: Feb. 7, 2017

(54) MULTI-PART HAIR CLIPPER HOUSING LID

(75) Inventor: Robert N. Buck, Jr., Rock Falls, IL (US)

(73) Assignee: WAHL CLIPPER CORPORATION, Sterling, IL (US)

( * ) Notice: Subject to any disclaimer, the term of this patent is extended or adjusted under 35 U.S.C. 154(b) by 460 days.

(21) Appl. No.: 13/236,071

(22) Filed: Sep. 19, 2011

(65) Prior Publication Data

US 2013/0067752 A1 Mar. 21, 2013

(51) Int. Cl.
*B26B 19/38* (2006.01)

(52) U.S. Cl.
CPC ..... *B26B 19/3853* (2013.01)

(58) Field of Classification Search
CPC ..... B25F 5/02; B25F 5/021; B25F 5/022; B26B 19/02; B26B 19/3853; B26B 19/38
USPC ..... 30/65, 60.5, 526, 210, 208, 209, 194, 30/341, 215, 216; 16/422, 423, 111.1; 403/380, 353, 263, 13, 14; 52/36.4, 36.5
See application file for complete search history.

(56) References Cited

U.S. PATENT DOCUMENTS

| | | | | | |
|---|---|---|---|---|---|
| 2,343,237 | A * | 3/1944 | McElroy et al. | 15/3.53 |
| D176,925 | S * | 2/1956 | Eisemann | D28/53 |
| 3,079,687 | A * | 3/1963 | Jepson | 30/210 |
| 3,589,007 | A * | 6/1971 | Walton | 30/140 |
| 4,845,847 | A * | 7/1989 | Yasunaka et al. | 30/34.1 |
| 5,350,250 | A * | 9/1994 | Nagler | E02F 3/3622 37/468 |
| 5,699,587 | A * | 12/1997 | Thul | 16/110.1 |
| 5,787,586 | A * | 8/1998 | Apprille et al. | 30/47 |
| 5,787,587 | A | 8/1998 | Wahl et al. | |
| 6,076,263 | A * | 6/2000 | Andis et al. | 30/216 |
| D435,936 | S | 1/2001 | Long et al. | |
| 6,612,078 | B2 * | 9/2003 | Hawang | 52/36.5 |
| D500,392 | S | 12/2004 | Buck, Jr. et al. | |
| 6,862,810 | B2 * | 3/2005 | Braun et al. | 30/210 |
| D568,542 | S | 5/2008 | Long et al. | |
| D597,254 | S | 7/2009 | Eddinger et al. | |
| D700,998 | S * | 3/2014 | Aulwes | D28/54 |
| D701,647 | S * | 3/2014 | Snow | D28/54 |
| D714,999 | S * | 10/2014 | Phillips | D28/54 |
| 2004/0216311 | A1 * | 11/2004 | Follo | 30/526 |

FOREIGN PATENT DOCUMENTS

| | | | | |
|---|---|---|---|---|
| CN | 2673038 Y | | 1/2005 | |
| JP | 03029688 A | * | 2/1991 | B26B 19/38 |
| JP | 04089082 A | * | 3/1992 | B26B 19/10 |

OTHER PUBLICATIONS

Chinese Office Action from Corresponding Chinese Patent Application No. CN 201210350159.7, dated Jan. 19, 2016.

* cited by examiner

*Primary Examiner* — Jennifer Swinney
(74) *Attorney, Agent, or Firm* — Greer, Burns & Crain, Ltd.

(57) ABSTRACT

A multi-part hair clipper housing lid is provided that is configured for engagement upon a main hair clipper housing. The lid includes a base having an interior portion defined by an interior edge, a trim piece having an outer trim edge configured for locating on the interior edge, the trim piece defining an inner space defined by an inner peripheral edge, and a cover configured for seating upon the inner peripheral edge and covering the inner space. The cover is constructed and arranged such that upon being fastened to the main housing, the trim piece is retained upon the base.

15 Claims, 6 Drawing Sheets

MULTI-PART HAIR CLIPPER HOUSING LID

BACKGROUND

The present invention relates generally to housings for powered hair clippers or trimmers (collectively referred to as "hair clippers"), and specifically to multi-part lids for such housings.

Multi-part clipper housing lids or covers are known, among others from U.S. D597,254; D568,542; D500,392 and D435,936. By providing lids in multiple components, hair clipper designers can optionally create a variety of appearances or grades of trim by utilizing different materials or surface treatments for selected lid components without creating new molds. Thus, a relatively large variety of appearance variations can be achieved without excessive tooling costs to create distinct housings for different products. Such lids typically include a main lid secured to a lower or main clipper housing by fasteners such as screws, or combinations of screws and snaps, and at least one cover that is secured to the main lid by snaps or chemical adhesive.

A challenge for clipper designers is developing multi-part lids configured so that the respective components can be easily secured together, as well as to the main housing. Another challenge is designing such lids which are readily disassembled when the clipper requires servicing. Many conventional multi-piece lids are snapped together such that breakage of the snaps and/or portions of the lid often occurs during disassembly.

SUMMARY

The above-identified needs are met or exceeded by providing a multi-part clipper lid which employs a single fastener to retain all of the lid components at one end of the lid to a main clipper housing. A trim component and a cover component each slide into place into specialized receptacles of a base component. In the preferred embodiment, both the trim component and the cover component slide into place on the base component using similar sliding motion and direction. Assembly of all the components is easily achieved without the use of force by assembly personnel greater than that needed for mere placement of the components, and the components readily nest together to form a flush exterior surface. Specialized depending locators on the trim and cover components engage accommodating receptacles on the base component which are configured to facilitate rapid assembly.

More specifically, a multi-part hair clipper housing lid is provided that is configured for engagement upon a main hair clipper housing. The lid includes a base having an interior portion defined by an interior edge, a trim piece having an outer trim edge configured for locating on the interior edge, the trim piece defining an inner space defined by an inner peripheral edge, and a cover configured for seating upon the inner peripheral edge and covering the inner space. The cover is constructed and arranged such that upon being fastened to the main housing, the trim piece is retained upon the base.

In another embodiment, a hair clipper housing is provided, including a main clipper housing, a multi-part hair clipper housing lid configured for engagement upon the main hair clipper housing, and a fastener. Included on the lid are a base, a trim piece and a cover. The base is configured for engaging the main clipper housing, having an interior portion defined by an interior edge. The trim piece has an outer trim edge configured for locating on the interior edge, and has an inner space defined by an inner peripheral edge. Configured for seating upon the peripheral edge and covering the inner space, the cover is constructed and arranged such that upon being fastened to the main housing, the trim piece is retained upon the base. The fastener engages the cover and fastens the cover to the main clipper housing such that the trim piece is held in place by the fastening of the cover.

DETAILED DESCRIPTION

Figure 1:
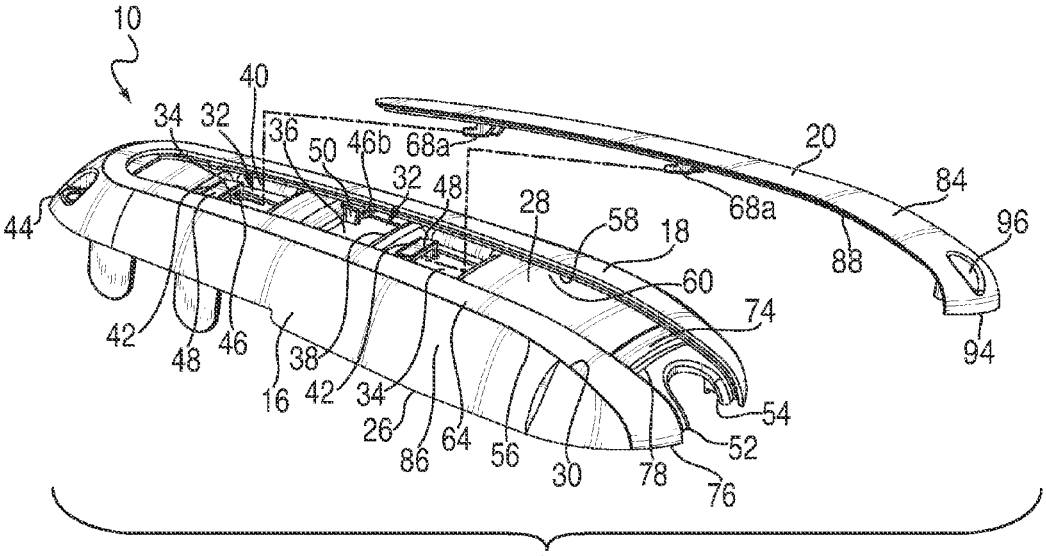
FIG. 1 is an exploded front perspective view of the present multi-part lid with a cover component exploded away.
Figure 2:
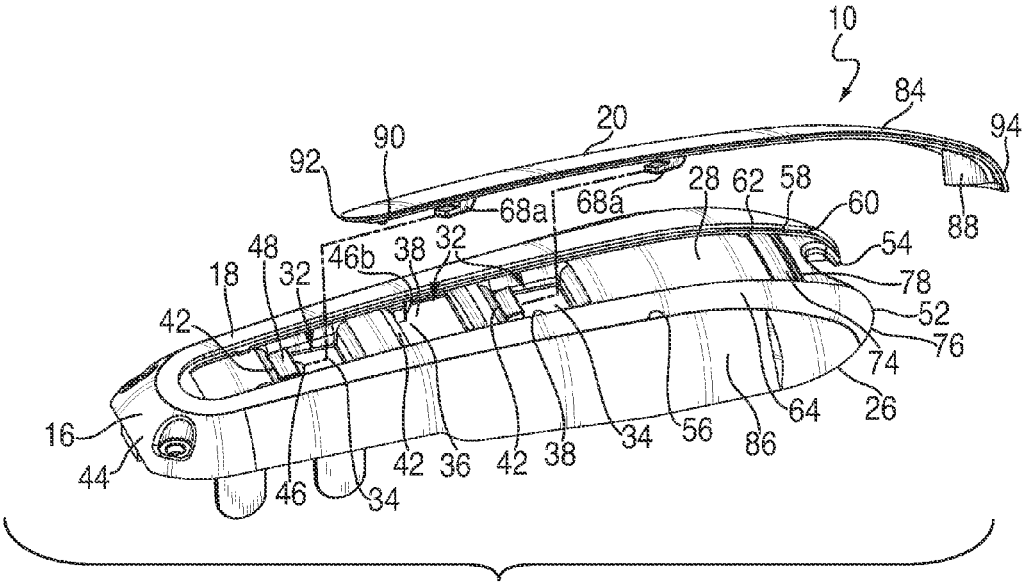
FIG. 2 is a exploded side perspective view of the multi-part lid of FIG. 1.
Figure 3:
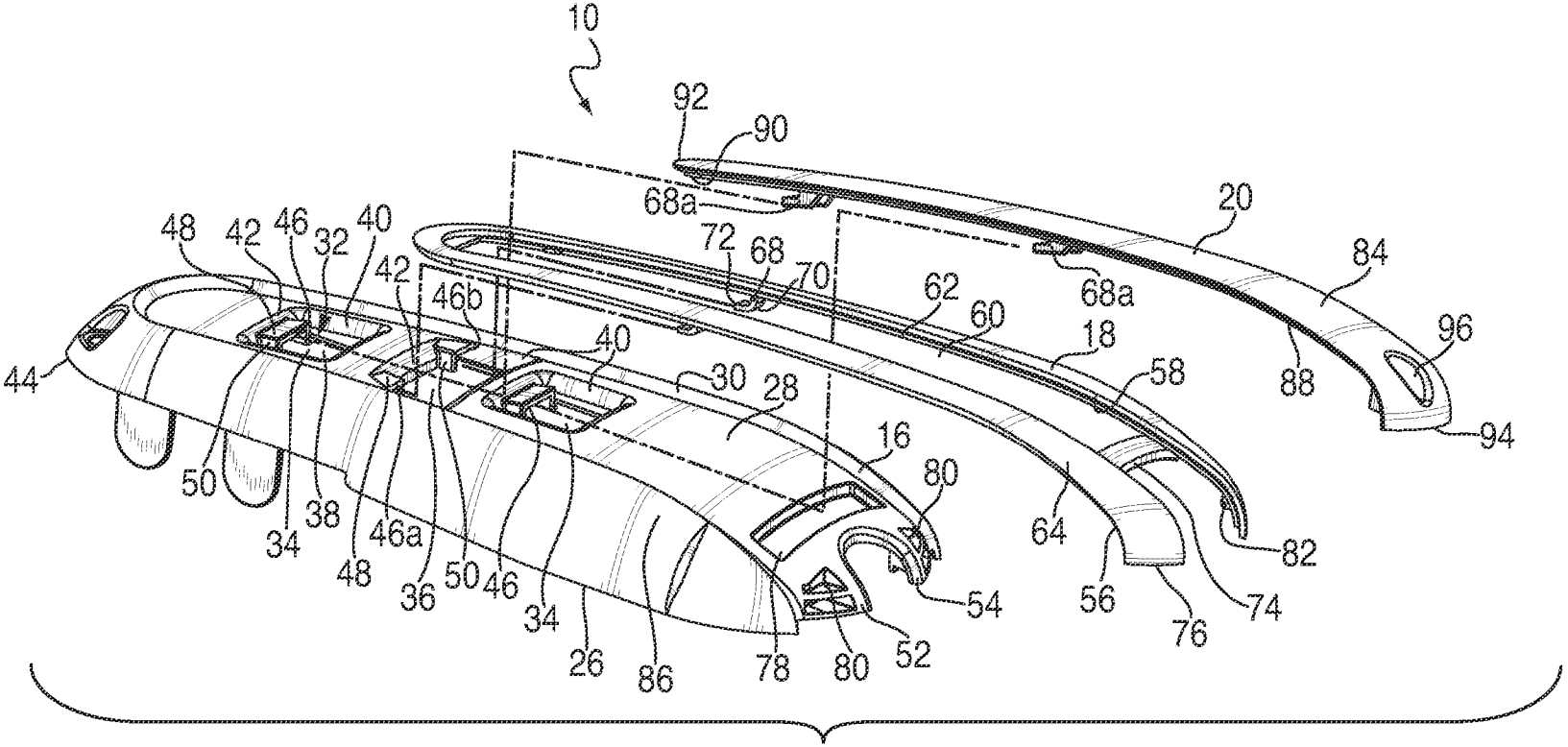
FIG. 3 is a completely exploded front perspective view of the present multi-part lid.
Figure 4:
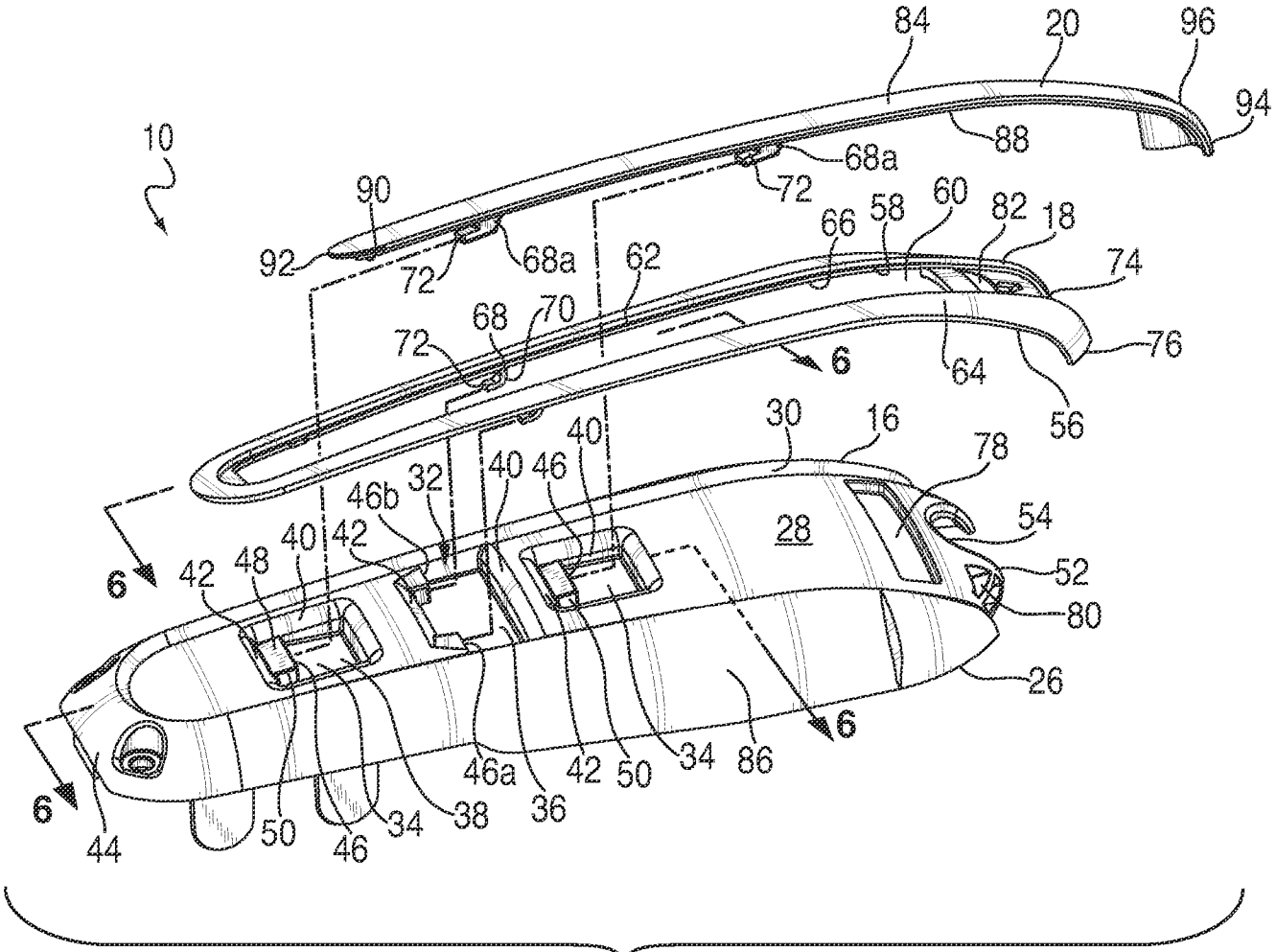
FIG. 4 is an exploded side perspective view of the multi-part lid of FIG. 3.
Figure 5:
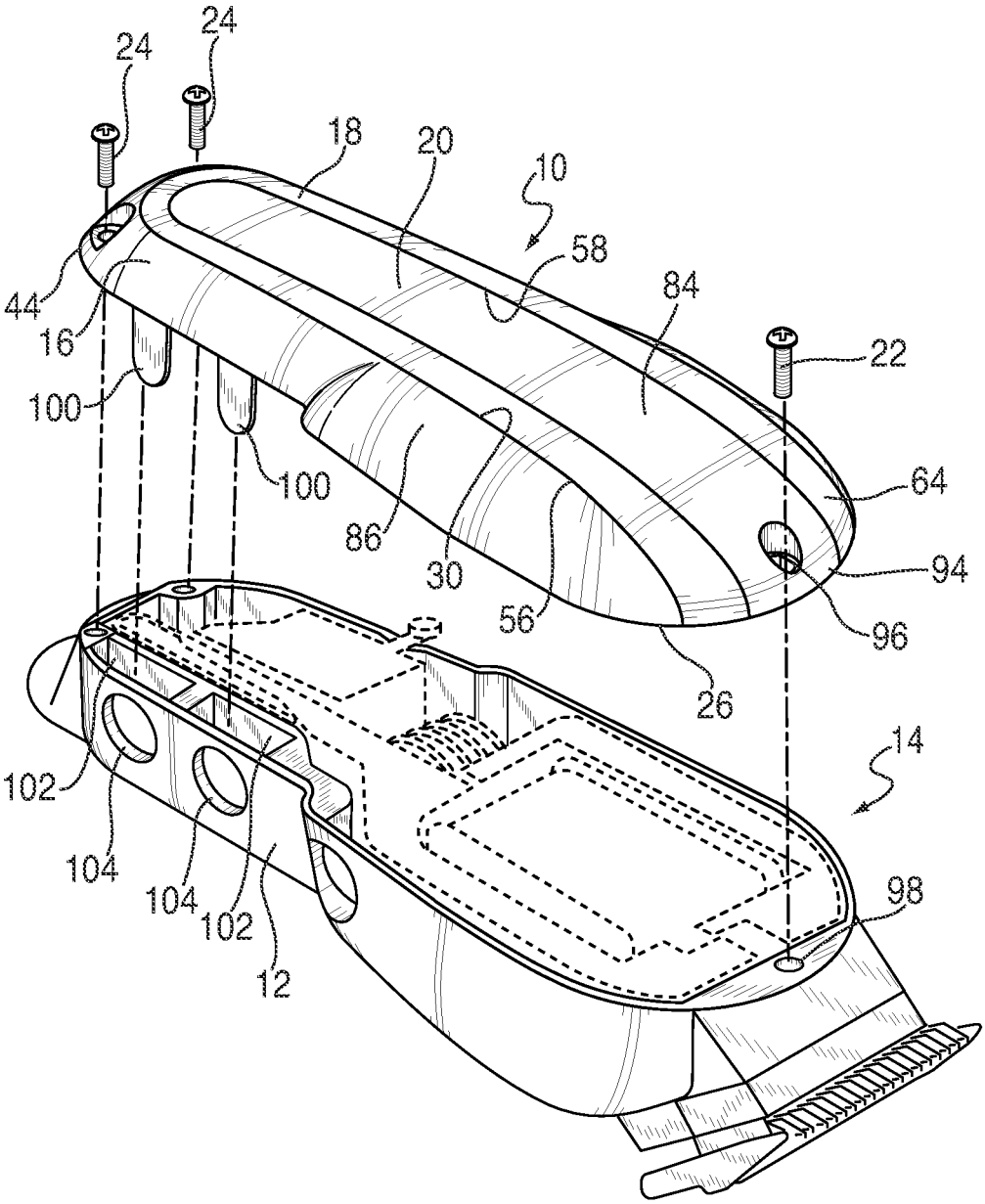
FIG. 5 is an exploded top perspective view showing the assembled multi-part lid exploded away from a main clipper housing.
Figure 6:
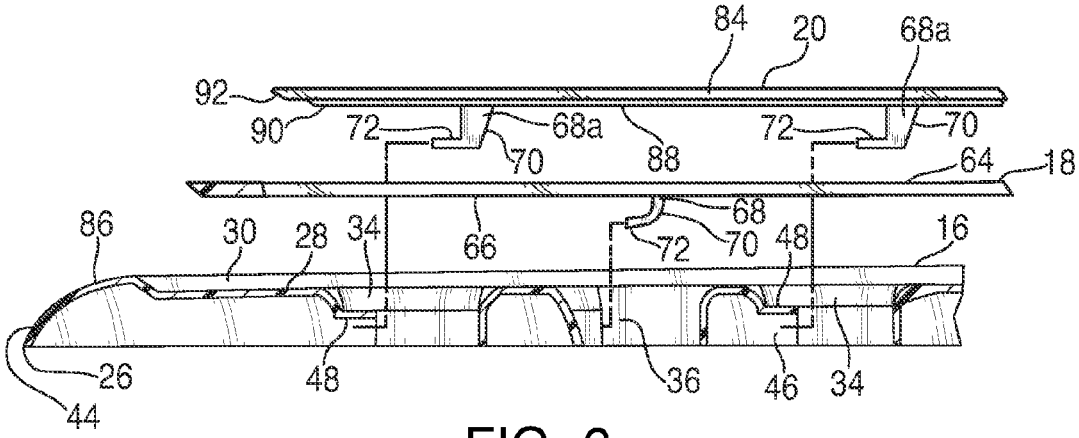
FIG. 6 is a cross-section taken along the line 6-6 of FIG. 4 in the direction generally indicated of the various components.
Figure 7:
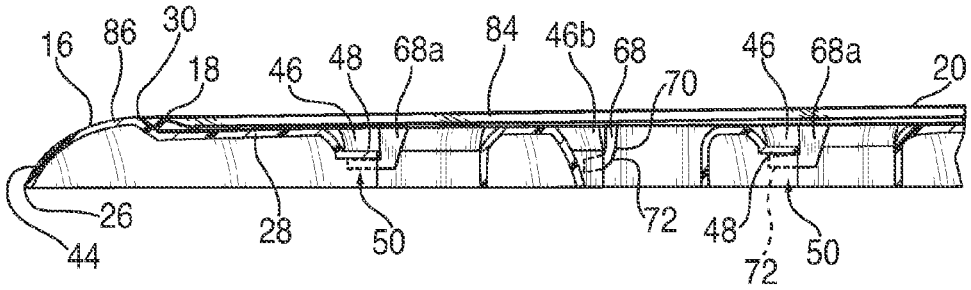
FIG. 7 is a cross-section taken along the line 6-6 of FIG. 4 upon the present multi-part lid upon assembly.
Figure 8:
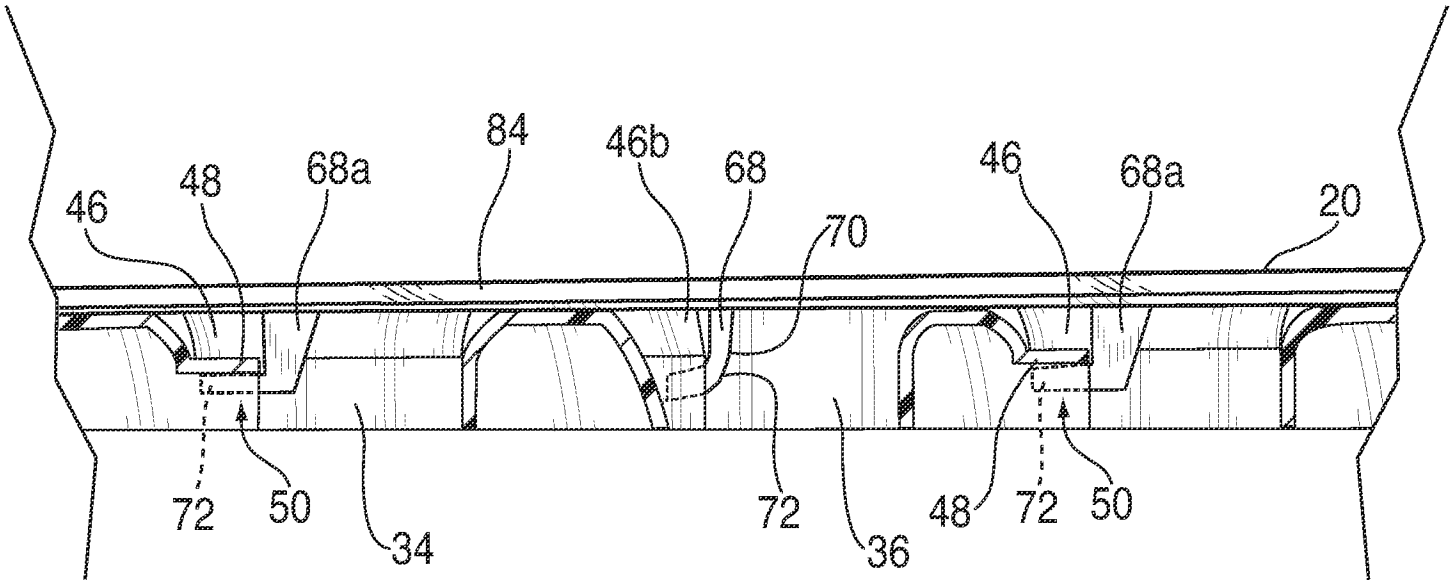
FIG. 8 is a fragmentary enlarged, vertical cross-section of FIG. 7.

Referring to FIGS. 1-3, a multi-part hair clipper housing lid incorporating the present invention is generally designated 10, and is constructed and arranged for mounting upon a main housing 12 of a hair clipper 14 (FIG. 5). While a particular hair clipper 14 is depicted, of the type disclosed in U.S. Pat. No. 5,787,587 incorporated by reference, it is contemplated that the features of the present lid 10 are configurable for any type of powered hair clipper housing. The present lid 10 includes three main parts or components: a base 16, a trim piece 18 and a cover 20. Advantages of the present lid 10 include that it is easy to assemble by factory personnel using similar repetitive motions without the use of excessive force beyond that which is needed to manipulate the parts. In addition, the present lid 10 is securable to the main housing 12 at one end with a single main fastener 22 (FIG. 5) such as a screw that secures the cover 20, the trim piece 18 and the base 16 to the main clipper housing. Another feature of the present lid 10 is that by removing the fastener 22 and other supplemental fasteners 24, the lid is disassembled without breaking any of the parts 16, 18, 20.

More specifically, the above-listed advantages are obtained by the construction of the present lid 10, which provides a sequential nesting relationship between the base 16, the trim piece 18 and the cover 20. The base 16 includes an outer periphery 26 which preferably corresponds to the plan profile of the main clipper housing 12 (FIG. 5), however variations are contemplated. Within the periphery 26 is an interior portion 28 defined by an interior edge 30. As depicted, the interior edge 30 is generally "U"-shaped and extends generally vertically relative to the interior portion 28, however it is understood that other shapes are considered suitable depending on the application. The interior portion 28 is a generally planar floor recessed below the interior edge 30.

Provided on the interior portion 28 is at least one and preferably a plurality of undercut recesses generally designated 32. In the preferred embodiment, the recesses 32 include a first type of recess 34 configured for securing the cover 20, and a second type of recess 36 configured for securing the trim piece 18 as will be described below. Both types of recesses 34, 36 include a relatively large recessed basin 38 defined by radiused walls 40. In the preferred embodiment, the walls 40 define the basins 38 into rectangular, square or otherwise polygonal shapes, however other shapes are contemplated.

Referring now to FIGS. 3-8, along a rearmost wall 42 of each of the recesses 32, located closest to a rear end 44 of the lid 10, is provided an undercut chamber or socket 46 defined largely by a top tab-like wall 48 and at least one sidewall 50. The tab-like wall 48 extends generally parallel to the interior portion 28, or generally horizontally when the clipper 14 rests upon a table in the position as depicted in FIG. 5. It should be noted that in the preferred lid 10, the recesses 34 each have a single socket 46, and the recess 36 has a pair of spaced sockets 46*a*, 46*b*. Also, the recess 36 is sandwiched on the interior portion 28 between a pair of the recesses 34. However, the specific number and arrangement of the recesses 34 and 36 may vary to suit the application. A front end 52 of the interior portion 28 is provided with a mounting opening 54 dimensioned to have a sufficient clearance for receiving the fastener 22 as it secures the lid 10 to the hair clipper main housing (FIG. 5).

The trim piece 18 is preferably generally "U"-shaped and has an outer trim edge 56 configured for locating on the interior edge 30 of the base 16. In addition, the trim piece 18 has an inner peripheral edge 58 defining a generally "U"-shaped inner space 60, which upon assembly is in communication with the interior portion 28. The inner peripheral edge 58 defines a recessed, stepped seat 62 that is recessed below an exterior surface 64.

On an underside 66 of the trim piece 18, at least one and preferably a pair of depending locators 68 are provided that are configured for engaging the trim piece recesses 36 in the base 16. Each locator 68 is integral with the trim piece 18 and is generally "L"-shaped, having a vertical leg 70 and a trailing leg 72. The trailing legs 72 project towards the rear end 44 of the lid 10. As seen in FIGS. 2, 3, 6 and 7, the trailing legs 72 slidably engage the undercut chambers or sockets 46 to locate and retain the trim piece 18 upon the base 16. Also, the locators 68 are preferably transversely aligned on the trim piece 18, however other arrangements are considered suitable.

To maintain the alignment of the trim piece 18, a transverse support bar 74 is integrally formed near a front end 76 of the trim piece. A transverse recess 78 formed in the interior portion 28 accommodates the support bar 74, and a pair of triangular recesses 80 (FIG. 3) accommodate rearwardly projecting locating lugs 82 (FIG. 4) formed on or secured to the underside 66. Thus, the trim piece 18 engages the base 16 at four separate locating positions, besides the engagement between the outer trim edge 56 and the interior edge 30. During assembly, the trim piece 18 is releasably positioned upon the base 16 using a sliding, front-to-rear motion of the assembler without using any force other than that needed for manipulating the parts. It will be seen that the recesses 36 are dimensioned to have a length in the direction of the longitudinal axis of the lid 10 that is longer than a length of the trailing leg 72 to facilitate the sliding installation motion and the location of the locators 68 into the sockets 46. FIGS. 1 and 2 depict the lid 10 with the trim piece 18 properly installed.

Referring now to FIGS. 1-8, the cover 20 is configured for releasably seating upon the inner peripheral edge 58 of the trim piece 18. It will be seen that the cover 20 is dimensioned to cover the inner space 60 and, upon installation to the lid 10, an exterior surface 84 of the cover is flush with both the exterior surface 64 of the trim piece 18 and an exterior surface 86 of the base 16.

An underside 88 of the cover 20 has a peripheral shoulder 90 defining a relatively thinner peripheral lip 92 (FIG. 6) dimensioned to nest upon the recessed inner seat 62 for facilitating the location of the cover upon the trim piece 18. Also included on the underside 88 is at least one and preferably a pair of "L"-shaped, depending locators 68*a*. The basic configuration and orientation of the locators 68*a* is the same as the locators 68, such that the trailing legs 72 all face the same direction, towards the rear end 44 of the lid 10. Thus, during assembly of the lid 10, the installer uses the same front-to-rear sliding motion in assembling the cover 20 upon the trim piece 18 as is used to install the trim piece upon the base 16. This construction facilitates clipper assembly.

However, it will be appreciated that the locators 68*a* are larger than the locators 68, and matingly and slidingly engage the sockets 46 in the recesses 34. Also, that the recesses 34 have a length in the direction of the longitudinal axis of the lid 10 that is greater than a length of the trailing legs 72 of each of the locators 68*a*. In addition, the locators 68*a* are disposed upon the underside 88 in an axially spaced orientation, instead of the transverse spacing of the locators 68 on the trim piece 18.

Referring now to FIG. 5, at a front end 94 of the cover 20, a fastener aperture 96 is constructed and arranged such that the single fastener 22 passes through both the aperture, and the mounting opening 54 in the base 16 for engaging a boss hole 98 in the main housing. As such, the fastener 22 retains the cover 20 upon the trim piece 18, and the trim piece upon the base 16 in a nested relationship to achieve a flush exterior and a uniform appearance of the lid 10. Thus, the trim piece 18 is securely retained upon the lid 10 through a clamping action exerted by the cover 20. Supplemental fasteners 24 pass through the base 16 for completely yet releasably securing the lid 10 to the main clipper housing 12. In addition, the base 16 is provided with at least one and preferably a pair of depending tabs 100 constructed and arranged for engaging corresponding sockets 102 in the main housing 12. As is known in the clipper art, the tabs 100 are used for closing off fastener apertures 104 used in the assembly of internal clipper motor components (not shown).

While a particular embodiment of the present multi-part hair clipper housing lid has been shown and described, it will be appreciated by those skilled in the art that changes and modifications may be made thereto without departing from the invention in its broader aspects and as set forth in the following claims.

What is claimed:

1. A multi-part hair clipper housing lid configured for engagement upon a main hair clipper housing, said lid comprising:

a base having an interior portion defined by an interior edge, said base including a plurality of recesses, wherein said recesses each define a socket;

a trim piece separate from said base and having an outer trim edge configured for locating on said interior edge, said trim piece defining an inner, generally U-shaped space when viewed from above and defined by an inner peripheral edge, and having a transverse support bar near a front end of said trim piece, wherein said transverse support bar connects a pair of legs forming said U-shaped space defining an opening;

a cover separate from said trim piece and said base and configured for seating upon said inner peripheral edge and covering said U-shaped space, and being constructed and arranged such that upon said cover being fastened to the main housing, said trim piece is retained upon said base;

said cover is provided with a fastener aperture constructed and arranged such that a single fastener passing through said aperture and engaging the main housing retains said cover at one end so that it clamps said trim piece and said base at said end to the main housing; and said trim piece having at least one depending locator and said cover having two depending locators separated by a distance and in alignment in a longitudinal direction, wherein said two depending locators of said cover extend through said opening of said trim piece when said cover is seated upon said trim piece, and one of said plurality of recesses in said base is configured for receiving said at least one depending locator of said trim piece being separate from other recesses in said base configured for receiving said depending locators of said cover, said depending locators all have trailing legs facing the same direction, and said sockets are complementarily shaped for receiving an associated one of said trailing edges, each said socket defined in part by a top wall and at least one sidewall and for accommodating sliding installation of both said trim piece and said cover upon said base, said recesses disposed in said base each having a single sockets, and said one of said plurality of recesses disposed for receiving said trim piece locator being disposed in said base between said other recesses for receiving said depending locators of said cover and having a pair of laterally spaced sockets, so that the sliding installation of said trim piece and said cover is in the same direction relative to said base, said base also having a transverse recess constructed and arranged for accommodating said transverse support bar.

2. The multi-part lid of claim 1, wherein said U-shaped space is in communication with said interior portion.

3. The multi-part lid of claim 1, wherein said trim piece is releasably engaged upon said base, and said cover is releasably seated upon said trim piece.

4. The multi-part lid of claim 1, wherein upon assembly of said cover upon said trim piece, and said trim piece upon said base, respective exterior surfaces are flush with each other.

5. The multi-part lid of claim 1, wherein said at least one depending locator is integral with said trim piece and said two depending locators are integral with said cover, and said at least one depending locator and said two depending locators are each generally "L"-shaped, with a vertical leg and a trailing leg.

6. The multi-part lid of claim 5, including a plurality of depending locators on each of said trim piece and said cover.

7. The multi-part lid of claim 6, wherein said trailing legs project toward a rear end of said trim piece and said cover.

8. The multi-part lid of claim 5, further including a plurality of said recesses including at least one undercut recess having a length greater than a length of said trailing leg for facilitating engagement of said at least one locator and said two depending locators during assembly.

9. The multi-part lid of claim 1 wherein said plurality of recesses in said base includes a first plurality of recesses configured for receiving said two depending locators on said cover, and a second plurality of recesses for receiving said at least one depending locator on said trim piece.

10. The multi-part lid of claim 1 wherein said cover has an underside with a peripheral shoulder defining a peripheral lip, and said trim piece inner peripheral edge defines a step dimensioned for engaging said peripheral lip.

11. A hair clipper housing, comprising:

a main clipper housing;

a multi-part hair clipper housing lid configured for engagement upon said main hair clipper housing, said lid including:

a base configured for engaging said main clipper housing, said base having an interior portion defined by an interior edge and a plurality of recesses each defining a socket;

a trim piece having an outer trim edge configured for locating on said interior edge, said trim piece defining an inner, generally U-shaped open space when viewed from above and defined by an inner peripheral edge, and having a transverse support bar near a front end of said trim piece, said transverse support bar connecting leas forming said U-shaped open space; and a cover being a separate piece from said trim piece and from said base, and configured for seating upon said inner peripheral edge and covering said inner space, and being constructed and arranged such that upon said cover being fastened to the main housing, said trim piece is retained upon said base;

a single fastener for engaging said cover and fastening said cover to said main clipper housing at on end such that said trim piece is held in place by said fastening of said cover, which clamps said trim piece against said base; and said trim piece having at least one depending locator and said cover having two depending locators separated by a distance and in alignment in a longitudinal direction, wherein said two depending locators of said cover extend through said opening of said trim piece when said cover is seated upon said trim piece, and one of said plurality of recesses in said base is configured for receiving said at least one depending locator of said trim piece being separate from other recesses in said base configured for receiving said two depending locators of said cover, said depending locators all have trailing legs facing the same direction, and said sockets are complementarily shaped for receiving an associated one of said trailing edges, each said socket defined in part by a top wall and at least one sidewall and for accommodating sliding installation of both said trim piece and said cover upon said base;

said recesses disposed in said base each having a single sockets, and said one of said plurality of recesses disposed for receiving said trim piece locator being disposed in said base between said other recesses for receiving said two depending locators of said cover and having a pair of laterally spaced sockets, so that the sliding installation of said trim piece and said cover is in the same direction relative to said base, said base also having a transverse recess constructed and arranged for accommodating said transverse support bar.

12. The housing of claim 11 wherein upon said cover being fastened to said main housing, respective exterior surfaces of said cover, said trim piece and said base are flush with each other.

13. The housing of claim 11 wherein said base has a periphery configured for corresponding with a main periphery of said main housing.

14. The housing of claim 11 wherein said base is provided with at least one depending tab constructed and arranged for engaging corresponding sockets in said main housing.

15. The housing of claim 11 wherein said base is secured to said main housing with at least one supplemental fastener in addition to said fastener.

* * * * *